US012758037B2

(12) United States Patent
Druckrey

(10) Patent No.: US 12,758,037 B2
(45) Date of Patent: Oct. 13, 2026

(54) EXTRUDED HOUSING FOR A MIRROR

(71) Applicant: Séura, Inc., Green Bay, WI (US)

(72) Inventor: Brennan Druckrey, Green Bay, WI (US)

(73) Assignee: Séura, Inc., Green Bay, WI (US)

( * ) Notice: Subject to any disclaimer, the term of this patent is extended or adjusted under 35 U.S.C. 154(b) by 250 days.

(21) Appl. No.: 18/448,679

(22) Filed: Aug. 11, 2023

(65) Prior Publication Data

US 2024/0049895 A1 Feb. 15, 2024

Related U.S. Application Data

(60) Provisional application No. 63/397,291, filed on Aug. 11, 2022.

(51) Int. Cl.
*A47G 1/02* (2006.01)
*A47G 1/16* (2006.01)

(52) U.S. Cl.
CPC ..... *A47G 1/02* (2013.01); *A47G 2001/1673* (2013.01)

(58) Field of Classification Search
None
See application file for complete search history.

(56) References Cited

U.S. PATENT DOCUMENTS

| | | | |
|---|---|---|---|
| 3,235,989 | A | 2/1966 | Brooks |
| 4,136,470 | A | 1/1979 | Barz |
| 4,452,000 | A | 6/1984 | Gandy |
| 4,662,092 | A | 5/1987 | Kim |
| 4,833,803 | A | 5/1989 | Schwartz |
| 4,839,974 | A | 6/1989 | Walter |
| 4,841,696 | A | 6/1989 | Miller |
| 4,924,631 | A | 5/1990 | Davies et al. |
| 5,022,688 | A | 6/1991 | Arnoldt |
| 5,069,849 | A | 12/1991 | Wain |
| 5,307,575 | A | 5/1994 | Ivansson et al. |
| 5,732,496 | A | 3/1998 | Tanaka |
| 6,108,997 | A | 8/2000 | Blais et al. |
| D536,881 | S | 2/2007 | Mischel, Jr. et al. |
| D545,067 | S | 6/2007 | Mischel, Jr. |
| D545,574 | S | 7/2007 | Mischel, Jr. |
| D546,073 | S | 7/2007 | Mischel, Jr. et al. |

(Continued)

FOREIGN PATENT DOCUMENTS

| | | | |
|---|---|---|---|
| CN | 209068290 | U | 7/2019 |
| EP | 3300639 | A1 | 4/2018 |

(Continued)

*Primary Examiner* — Jyotsna V Dabbi
(74) *Attorney, Agent, or Firm* — Michael Best & Friedrich LLP

(57) ABSTRACT

A housing assembly for an illuminated mirror including a side member including a base wall, a first sidewall, and a second sidewall defining a channel, the base wall including an inner base wall spaced from an outer base wall and defining a first slot, and a corner member including a corner member base wall, an interior sidewall, and an exterior sidewall defining a corner member channel, a first mounting tab projecting from a first end of the corner member base wall, wherein the first mounting tab is configured to be received by the first slot of the side member to interlock the corner member to the side member.

17 Claims, 13 Drawing Sheets

(56) References Cited

U.S. PATENT DOCUMENTS

| | | | | |
|---|---|---|---|---|
| D546,566 | S | 7/2007 | Mischel, Jr. | |
| D547,071 | S | 7/2007 | Mischel, Jr. et al. | |
| D552,359 | S | 10/2007 | Mischel, Jr. | |
| D579,671 | S | 11/2008 | Mischel, Jr. | |
| D620,718 | S | 8/2010 | Mischel, Jr. et al. | |
| 7,805,260 | B2 | 9/2010 | Mischel, Jr. et al. | |
| 7,853,414 | B2 | 12/2010 | Mischel, Jr. et al. | |
| 7,883,252 | B2 | 2/2011 | Matsui et al. | |
| 7,931,326 | B2 | 4/2011 | Beshiri | |
| 8,002,490 | B2 | 8/2011 | Hamlen | |
| D652,568 | S | 1/2012 | Trzesniowski | |
| D652,986 | S | 1/2012 | Trzesniowski | |
| 8,099,247 | B2 | 1/2012 | Mischel, Jr. et al. | |
| 8,267,546 | B2 | 9/2012 | Reith et al. | |
| 8,292,457 | B2 | 10/2012 | Schenk et al. | |
| 8,523,388 | B2 | 9/2013 | Wu | |
| D704,938 | S | 5/2014 | Mischel, Jr. et al. | |
| D704,939 | S | 5/2014 | Mischel, Jr. | |
| 8,880,360 | B2 | 11/2014 | Mischel, Jr. et al. | |
| 8,910,402 | B2 | 12/2014 | Mischel, Jr. et al. | |
| 9,105,202 | B2 | 8/2015 | Mischel, Jr. | |
| 9,192,255 | B2 | 11/2015 | Burrous et al. | |
| 9,307,849 | B2 | 4/2016 | Uhl | |
| D754,979 | S | 5/2016 | Starck | |
| 9,500,354 | B2 | 11/2016 | Gierens et al. | |
| 9,724,442 | B1 | 8/2017 | Munn | |
| 9,845,537 | B2 | 12/2017 | Mischel, Jr. et al. | |
| 9,921,390 | B1 | 3/2018 | Mischel, Jr. et al. | |
| 9,933,595 | B1 | 4/2018 | Mischel, Jr. et al. | |
| 10,039,853 | B1 | 8/2018 | Munn | |
| 10,106,896 | B2 | 10/2018 | Mischel, Jr. et al. | |
| 10,456,496 | B2 | 10/2019 | Munn | |
| 10,463,759 | B2 | 11/2019 | Munn | |
| 10,502,928 | B1 | 12/2019 | Mischel, Jr. et al. | |
| 10,639,394 | B2 | 5/2020 | Munn | |
| 10,670,258 | B2 | 6/2020 | Veltri et al. | |
| 10,813,478 | B2 | 10/2020 | Spiro et al. | |
| 10,823,391 | B2 | 11/2020 | Thomas et al. | |
| 10,939,522 | B1 | 3/2021 | Mischel, Jr. et al. | |
| 10,948,176 | B1 | 3/2021 | Johnston et al. | |
| 10,968,523 | B1 | 4/2021 | Mischel, Jr. et al. | |
| 11,087,649 | B2 | 8/2021 | Anderson | |
| 11,825,964 | B1 * | 11/2023 | Johnston | A47G 1/0605 |
| 2002/0176741 | A1 | 11/2002 | Anderson | |
| 2005/0129460 | A1 * | 6/2005 | Medcalf | G09F 1/12 403/403 |
| 2007/0211452 | A1 | 9/2007 | Gaunce et al. | |
| 2010/0270825 | A1 | 10/2010 | Beshiri et al. | |
| 2012/0262918 | A1 | 10/2012 | Delhorme et al. | |
| 2013/0025050 | A1 | 1/2013 | Syrowitz et al. | |
| 2013/0027971 | A1 | 1/2013 | Huang et al. | |
| 2013/0272777 | A1 | 10/2013 | Hayter et al. | |
| 2016/0186983 | A1 | 6/2016 | Dubiel | |
| 2016/0341415 | A1 * | 11/2016 | Lumaye | A47G 1/02 |
| 2018/0023799 | A1 * | 1/2018 | Lumaye | A47G 1/02 362/135 |
| 2019/0328161 | A1 | 10/2019 | Wei | |

FOREIGN PATENT DOCUMENTS

| | | | | |
|---|---|---|---|---|
| GB | 2102094 | B1 | 6/1985 | |
| KR | 101533918 | B1 | 7/2015 | |
| KR | 20170057186 | A | 5/2017 | |
| KR | 101843060 | B1 | 3/2018 | |
| KR | 101902514 | B1 | 10/2018 | |
| KR | 102000406 | B1 | 7/2019 | |
| KR | 102107788 | B1 | 5/2020 | |
| KR | 102138458 | B1 | 7/2020 | |
| KR | 102288828 | B1 | 8/2021 | |
| KR | 102341303 | B1 | 12/2021 | |
| KR | 102699168 | B1 * | 8/2024 | F21V 33/004 |
| WO | 2006117879 | A1 | 11/2006 | |
| WO | 2011080453 | A1 | 7/2011 | |
| WO | WO-2012022009 | A1 * | 2/2012 | A47B 88/90 |
| WO | 2012028814 | A1 | 3/2012 | |
| WO | 2012028819 | A1 | 3/2012 | |
| WO | 2012035258 | A1 | 3/2012 | |
| WO | 2012168647 | A1 | 12/2012 | |
| WO | 2021037569 | A1 | 3/2021 | |

* cited by examiner

EXTRUDED HOUSING FOR A MIRROR

CROSS-REFERENCE TO RELATED APPLICATIONS

This application claims priority to U.S. Provisional Patent Application No. 63/397,291, which was filed on Aug. 11, 2022 and titled "Extruded Housing for a Mirror," the contents of which is hereby incorporated by reference in its entirety.

FIELD OF THE DISCLOSURE

The present disclosure relates to a housing for a mirror. More specifically, the present disclosure relates to a housing for a mirror that is extruded, cut to size, assembled, and then installed to an illuminated mirror.

BACKGROUND

Housings for an illuminated mirror are generally known in the art. These known housings are formed of metal and include a top component, a bottom component, and two side components that form a square or rectangular housing. The top and bottom components are generally different in shape and design than the side components. The top and bottom components are customized to a mirror width and etch design, which facilitates illumination (e.g., task lighting, ambient lighting, accent lighting, etc.). The side components are customized to a mirror height. Unfortunately, these metal components that form a housing have certain limitations. For example, since the metal components are custom fabricated for different sized mirrors, and further utilized in illuminated mirrors, the components must go through a plurality of manufacturing steps to form and finish each component. Manufacturing includes custom lengths and sizes based on mirror size, along with providing suitable mounting systems for attaching and positioning a light source and associated electronics for operation. Finishing includes application of a coating that assists with reflecting and/or directing light to achieve a desired illuminance (measured in lux). The custom fabrication requires substantial lead time, which can delay manufacturing of the mirror. In addition, since the top components, bottom component, and side components are all different in design (along with size), there is additional supply chain and production complexities to manufacture a housing. Accordingly, there is a need to improve components of an illuminated mirror housing to reduce manufacturing lead time, reduce customized inventory, and standardize components, while also providing a desired strength, ability to attach a light source and associated electronics at a variety of positions based on a desired etch design, and illuminance.

SUMMARY

In one example of an embodiment, a housing assembly for an illuminated mirror includes a side member including a base wall, a first sidewall, and a second sidewall defining a channel, the base wall including an inner base wall spaced from an outer base wall and defining a first slot, and a corner member including a corner member base wall, an interior sidewall, and an exterior sidewall defining a corner member channel, a first mounting tab projecting from a first end of the corner member base wall, wherein the first mounting tab is configured to be received by the first slot of the side member to interlock the corner member to the side member.

In another example of an embodiment, a housing assembly for an illuminated mirror includes alternating interlocking side members and corner members, each side member including a base wall, a first sidewall, and a second sidewall defining a side member channel, the base wall including an inner base wall spaced from an outer base wall and defining a first slot. Each corner member includes a corner member base wall, an interior sidewall, and an exterior sidewall defining a first corner member channel, a first mounting tab projecting from a first end of the corner member base wall, and a second mounting tab projecting from a second end of the corner member base wall, wherein the first mounting tab is configured to be received by the first slot of one adjacent side member, and the second mounting tab is configured to be received by the first slot of the other adjacent side member.

Other aspects of the invention will become apparent by consideration of the detailed description and accompanying drawings.

Figure 1:
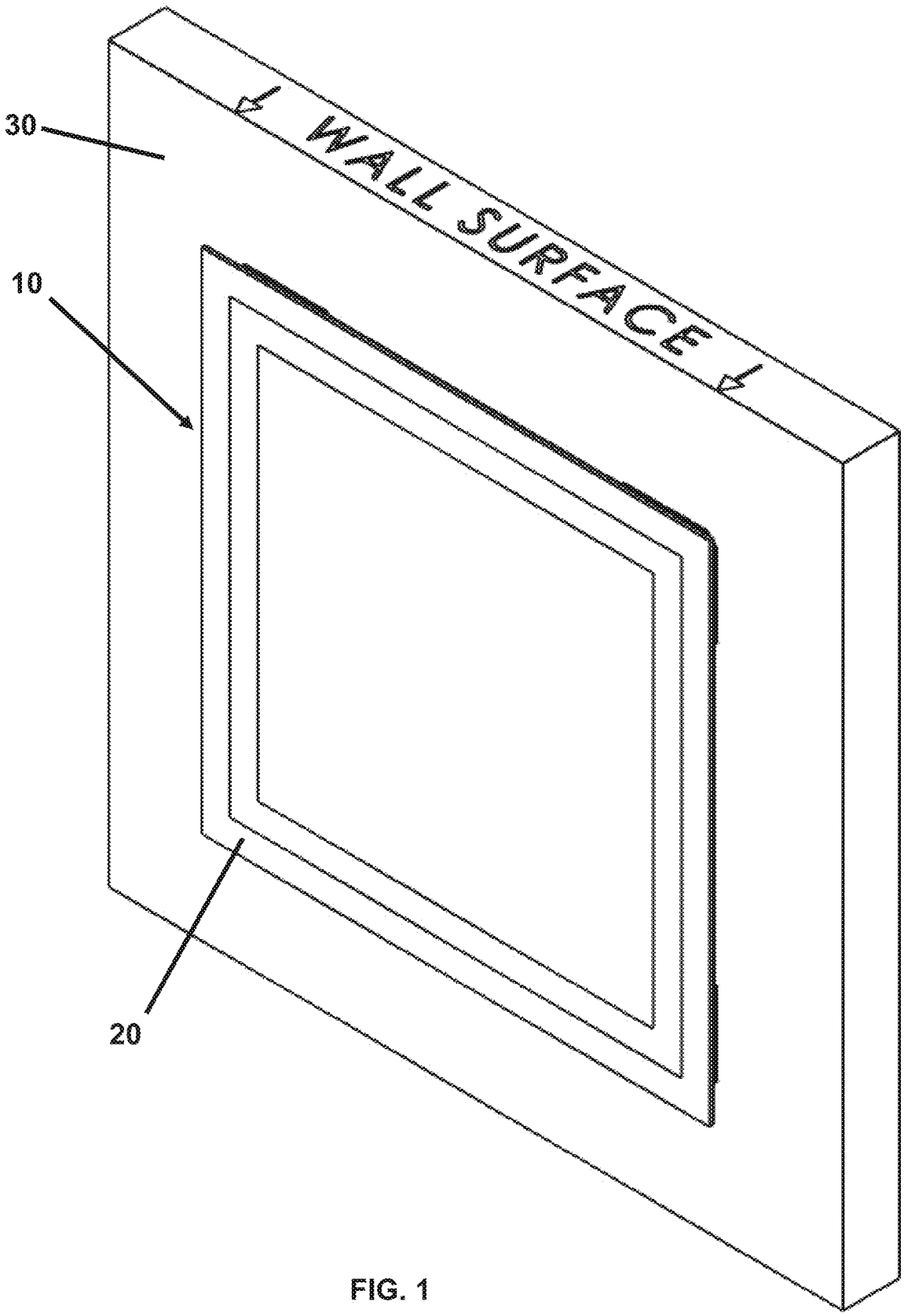
FIG. 1 is a perspective view of an example of an embodiment of a mirror assembly that integrates a housing assembly to facilitate mounting to a wall.

Before embodiments of the disclosure are explained in detail, it is to be understood that the disclosure is not limited in its application to the details of construction and the arrangement of components set forth in the following description or illustrated in the accompanying drawings. The disclosure is capable of supporting other embodiments and of being practiced or of being carried out in various ways.

DETAILED DESCRIPTION

The present disclosure is directed to a housing assembly 100 for a mirror assembly 10, and more specifically an illuminated mirror assembly 10. The housing assembly 100 includes a plurality of side members 104 and a plurality of corner members 108. The side members 104 can be extruded and cut to any suitable size to form a customized housing assembly 100 in response to an associated size of a mirror. The side members 104 have a geometry that provides a plurality of mounting positions for an illumination source and efficient assembly with corner member 108. Since the side members 104 are cut to size to form a customized housing assembly 100 size for a desired sized mirror, the side members 104 advantageously reduce the need for customized metal components, simplifying inventory and supply chain complexity.

With reference now to the figures, FIG. 1 is a perspective view of a mirror assembly 10. The mirror assembly 10 includes a reflective mirror surface 20 and a housing assembly 100 (shown in FIG. 2). The mirror assembly 10 is configured to mount to a structural support 30, such as an interior wall 30.

Figure 2:
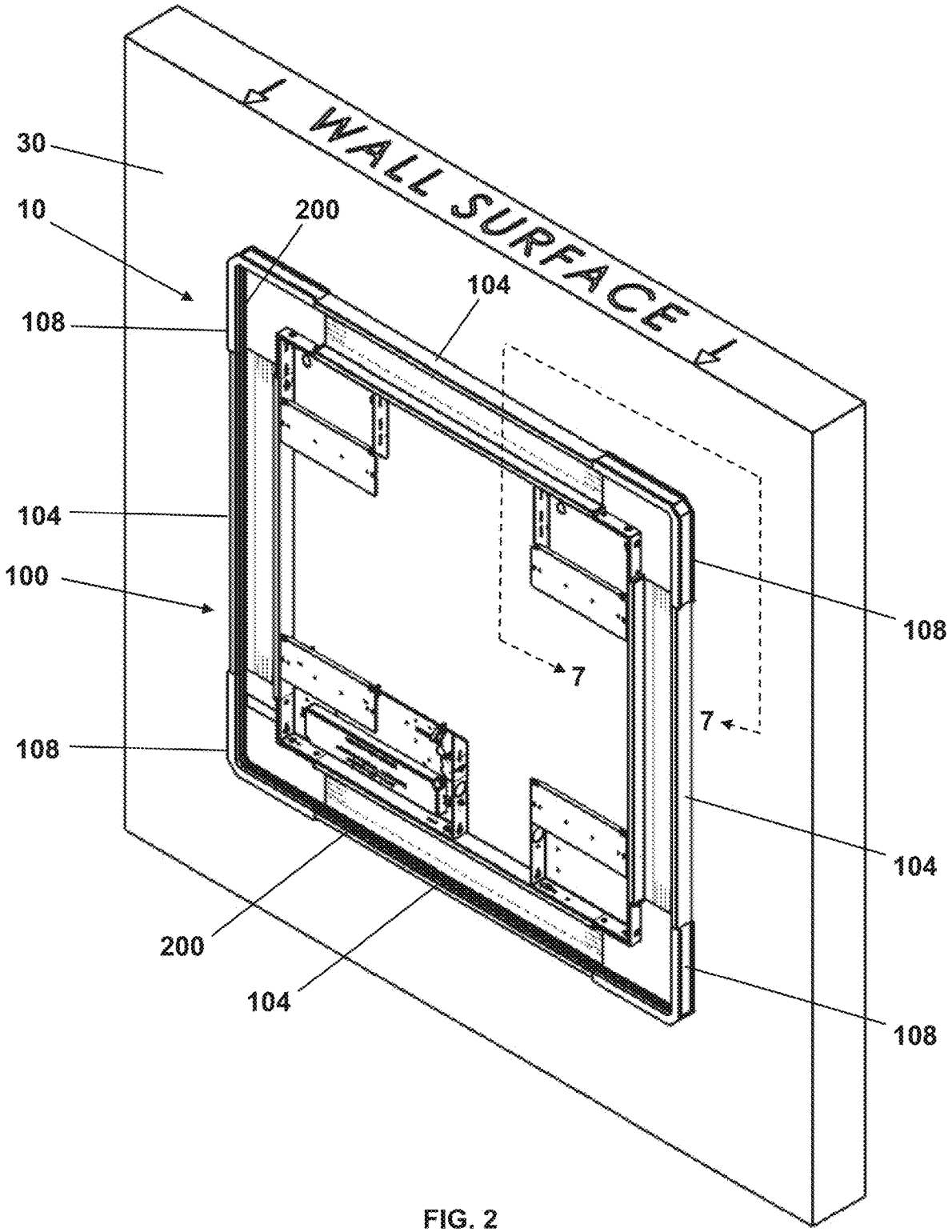
FIG. 2 is a perspective view of the mirror assembly of FIG. 1 with the mirror removed and showing the housing assembly mounted to the wall.

FIG. 2 is a perspective view of the mirror assembly 10 with the reflective mirror surface 20 (shown in FIG. 1) removed to depict the housing assembly 100 selectively mounted to the wall 30. The housing assembly 100 is defined by a plurality of side members 104 and a plurality of corner members 108. The mirror surface 20 (shown in FIG. 1) is configured to be fastened to the housing assembly 100.

Figure 3:
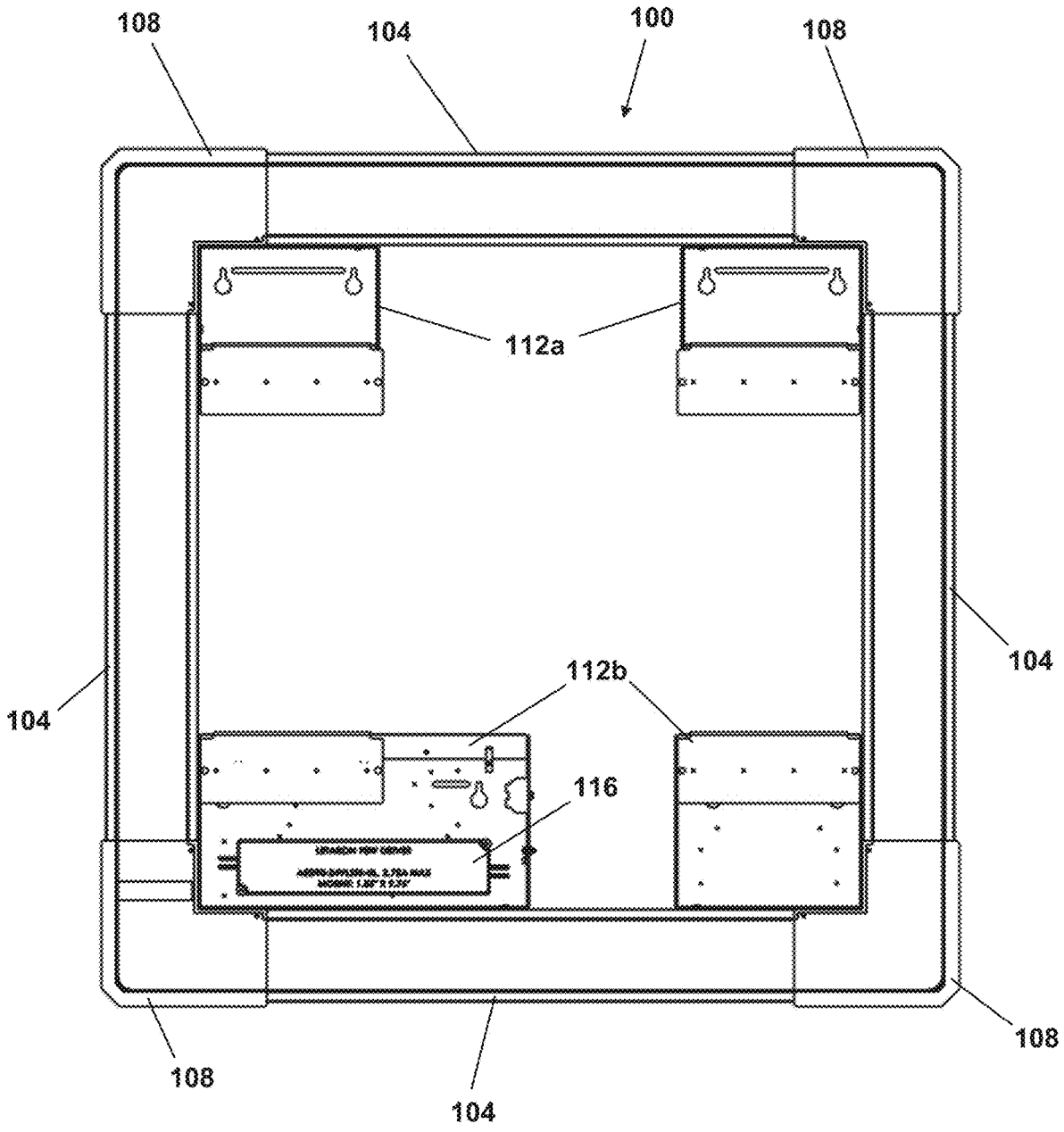
FIG. 3 is a front plan view of the mirror assembly of FIG. 2 with the wall removed.

With reference to FIG. 3, the housing assembly 100 also includes a plurality of mounting brackets 112*a, b*. In the illustrated embodiment, the mounting brackets include a pair of first mounting brackets 112*a* and a pair of second mounting brackets 112*b*. While the illustrated embodiment depicts the first mounting brackets 112*a* being smaller than then second mounting brackets 112*b*, in other embodiments the plurality of mounting brackets can be all the same size (e.g., all the brackets 112 can be brackets 112*a*, brackets 112*b*, etc.). Each mounting bracket 112*a*, 112*b* includes at least one aperture for receiving a mounting fastener (a fastener for mounting the housing assembly 100 to the wall 30 (or other surface 30) (shown in FIG. 2). The second mounting brackets 112*b* are further configured to carry and otherwise engage electronics 116 for powering an illumination source (or light source). Each mounting bracket 112*a*, 112*b* is configured to fasten to an associated corner member 108 and at least one adjacent side member 104. In some examples of embodiments, each mounting bracket 112*a*, 112*b* can fasten to a corner member 108 or to side members 104 adjacent to each corner member 108. The mounting brackets 112*a*, 112*b* can be fastened by any suitable fastener (e.g., a screw, a bolt, etc.). It should also be appreciated that the housing assembly 100 is configured to fasten to a back (or rear) side of the mirror surface 20. For example, the mounting brackets 112*a*, 112*b* can be fastened to the back side of the mirror surface 20 by any suitable fastening system (e.g., a fastener, an adhesive, etc.).

Figure 4:
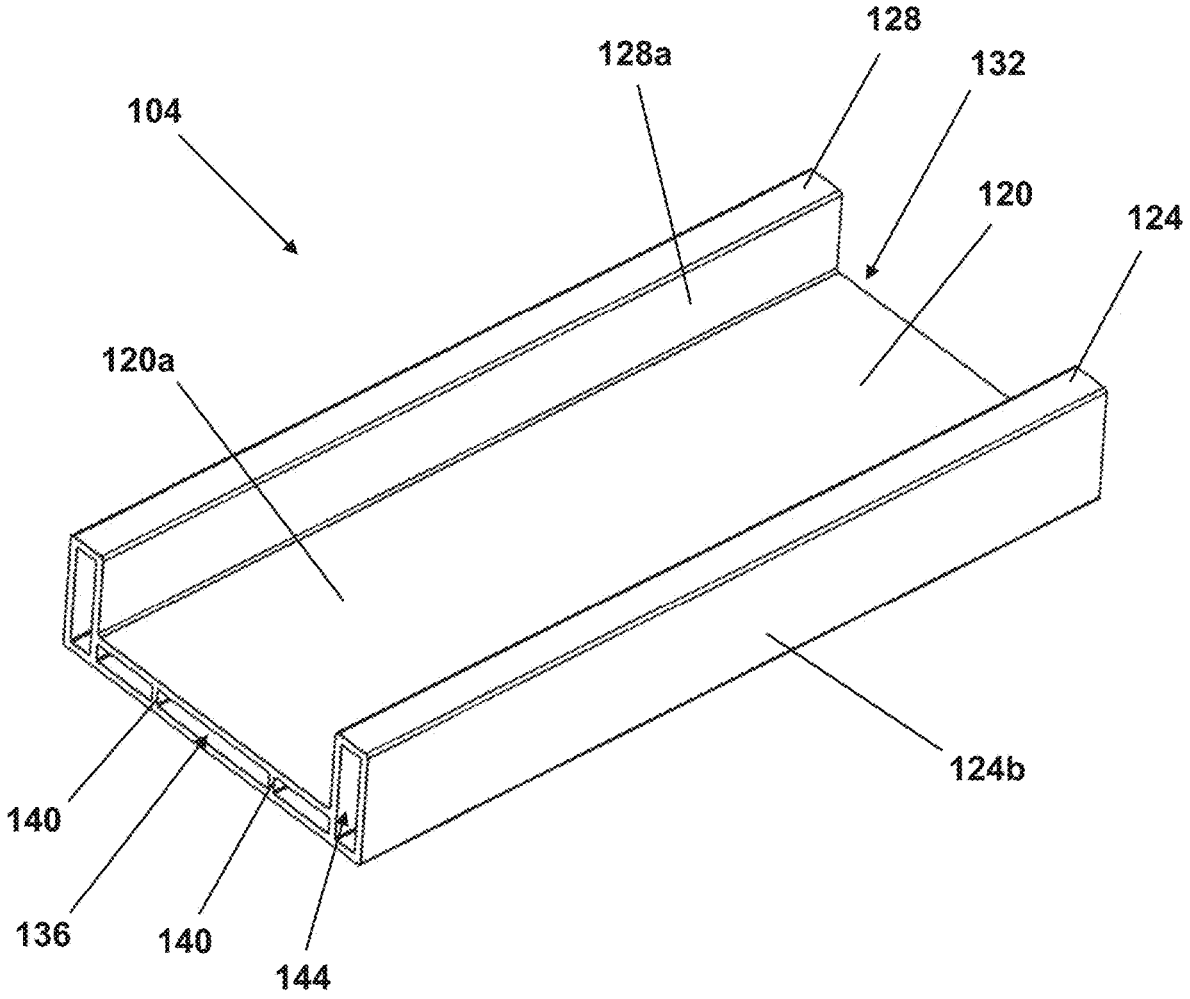
FIG. 4 is a perspective view of a first side of a side member for use with the housing assembly of FIG. 2.
Figure 5:
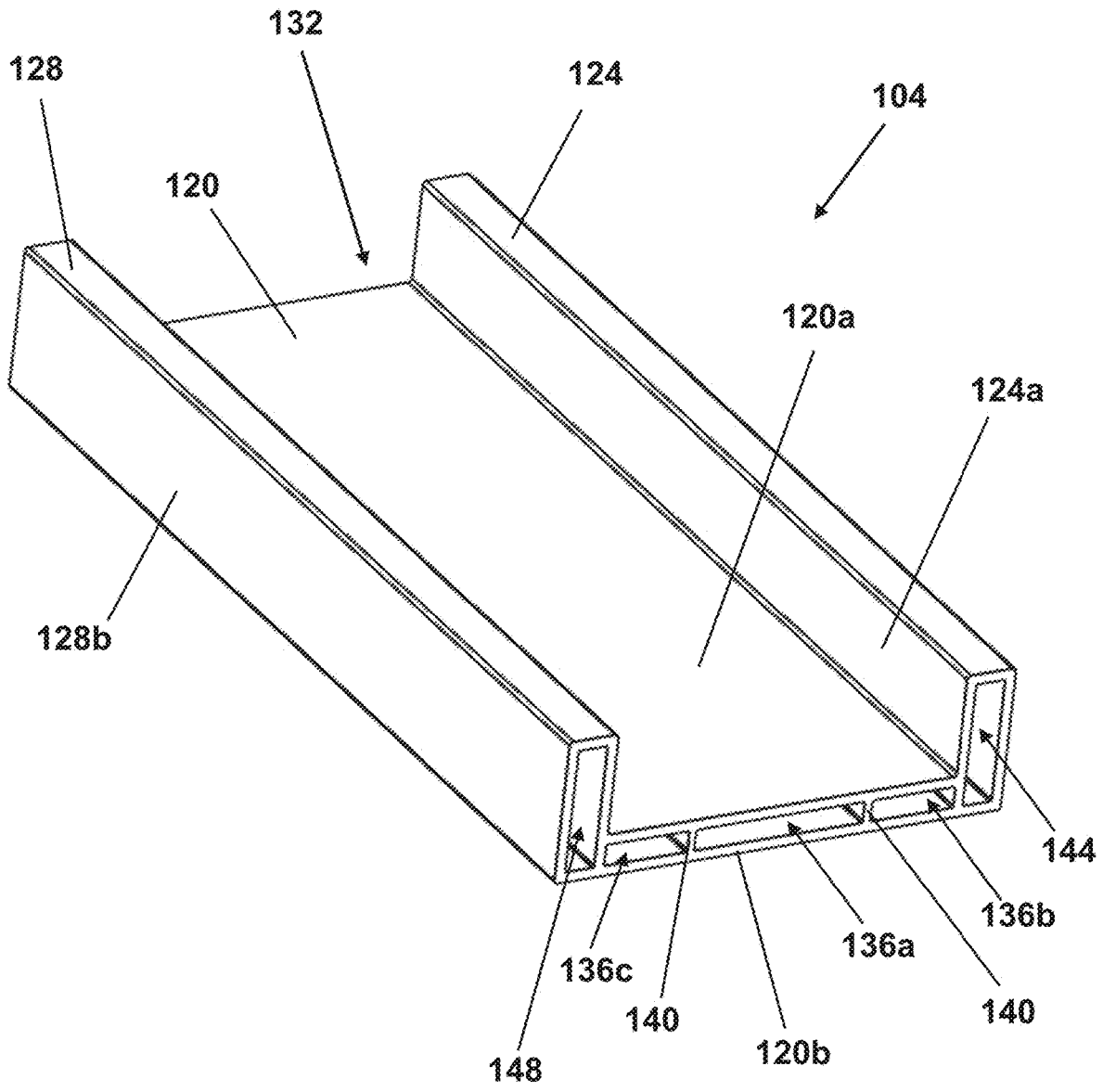
FIG. 5 is a perspective view of a second side of the side member of FIG. 4.
Figure 6:
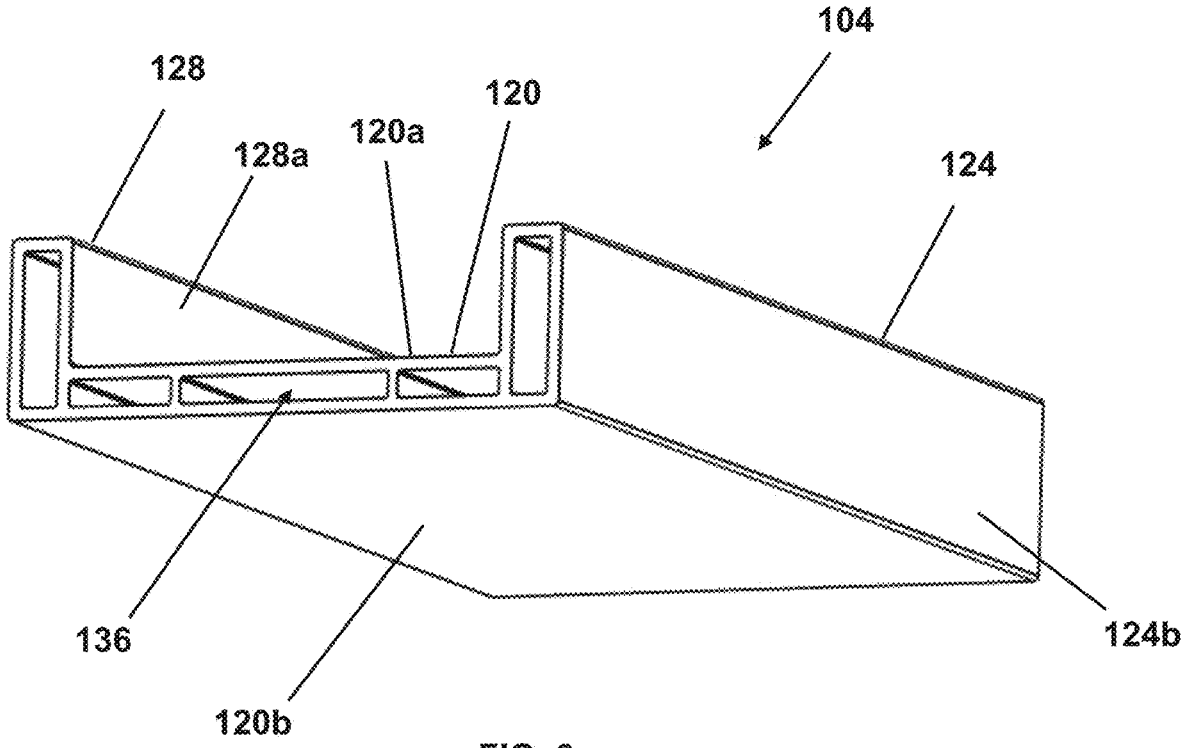
FIG. 6 is a perspective view of a bottom side of the side member of FIG. 4.

With reference now to FIGS. 4-6, three different perspective views of a portion of the side member 104 is illustrated. The perspective views illustrate a partial cross-sectional view of the side member 104. With specific reference to FIGS. 4-5, the side member 104 includes a first portion 120 (or base wall 120), a second portion 124 (or first sidewall 124), and a third portion 128 (or a second sidewall 128). The first portion 120 is arranged between the second and third portions 124, 128. More specifically, the second and third portions 124, 128 are positioned on opposing edges of the first portion 120. The first, second, and third portions 120, 124, 128 cooperate to define a channel 132. Stated another way, the inner walls 120*a*, 124*a*, 128*a* define the channel 132. In the illustrated embodiment, the channel 132 has an approximate U-shaped (or C-shaped) cross-section. In addition, the second portion 124 is approximately orthogonal to the first portion 120, and the third portion 128 is approximately orthogonal to the first portion 120. As such, the second and third portions 124, 128 (or first and second sidewalls 124, 128) are oriented to be parallel to each other. In other examples of embodiments, the second portion 124 can be oblique to the first portion 120, and the third portion 128 can be oblique to the first portion 120. In the illustrated embodiment, the first portion 120 is wider than a corresponding height of the second and third portions 124, 128. As previously noted, the side members 104 can be formed through extrusion (or plastic extrusion or extruded). It should also be appreciated that the side member 104 can be oriented such that either sidewall 124, 128 can be an external sidewall. Stated another way, in one embodiment, one of the sidewalls 124, 128 can be an external sidewall of the housing assembly 100 and the other of the sidewalls 128, 124 can be an internal sidewall of the housing assembly 100. In another embodiment, one of the sidewalls 128, 124 can be the external sidewall of the housing assembly 100 and the other of the sidewalls 124, 128 can be the internal sidewall of the housing assembly 100.

The first, second, and third portions 120, 124, 128 of the side member 104 are formed by a double wall construction. More specifically, the first portion 120 (or base wall 120) includes an inner wall 120*a* (or interior base wall 120*a* or inner base wall 120*a*) spaced from an outer wall 120*b* (or exterior base wall 120*b* or outer base wall 120*b*) (shown in FIG. 6). The spaced walls 120*a*, 120*b* form a first passage 136 (or first channel 136 or first slot 136) between the walls 120*a*, 120*b*. The spaced walls 120*a*, 120*b* are parallel to each other. In the illustrated embodiment, the first passage 136 is divided into a plurality of first passages 136*a, b, c* (shown FIG. 5) by a plurality of intermediate supports 140 (also shown in FIG. 5). In other examples of embodiments, the first passage 136 can be divided into a plurality of first passages 136 by at least one intermediate support 140, or the first passage 136 does not include any intermediate supports 140. The intermediate supports 140 can be provided to provide additional strength or rigidity to the first passage 136 between the opposing walls 120*a*, 120*b*.

With continued reference to FIGS. 4-5, the second portion 124 (or first sidewall 124) similarly includes an inner wall 124*a* (or first interior wall 124*a* or first interior sidewall 124*a* or first inner sidewall 124*a*) (shown in FIG. 5) spaced from an outer wall 124*b* (or first exterior wall 124*b* or first exterior sidewall 124*a* or first outer sidewall 124*b*) (shown in FIG. 4). The spaced walls 124*a*, 124*b* form a second passage 144 (or second channel 144 of second slot 144) between the walls 124*a*, 124*b*. It should be appreciated that the second passage 144 is partially defined by the first sidewall 124 (or second portion 124) and is partially defined by the base wall 120 (or first portion 120) including the exterior base wall 120*b*.

The third portion 128 (or second sidewall 128) includes an inner wall 128*a* (or second interior wall 128*a* or second inner sidewall 128*a*) (shown in FIG. 4) spaced from an outer wall 128*b* (or second exterior wall 128*b* or second outer sidewall 128*b*) (shown in FIG. 5). The spaced walls 128*a*, 128*b* form a third passage 148 (or third channel 148 or third slot 148) between the walls 128*a*, 128*b*. It should be appreciated that the third passage 148 is partially defined by the second sidewall 128 (or third portion 128) and is partially defined by the base wall 120 (or first portion 120) including the exterior base wall 120*b*.

The passages 136, 144, 148 allow for a reduction in material, decreasing the weight of the side member 104 while providing a suitable structural rigidity to support the housing assembly 100. The passages 136, 144, 148 also facilitate engagement with the corner member 108, which is discussed in additional detail below.

The channel 132 of the side member 104 provides a plurality of mounting surfaces for mounting a light source 200 (shown in FIG. 2). As a nonlimiting example, the light source 200 can be a chip on board (COB) light emitting diode (LED) strip 200. The COB LED strip 200 (illumination source 200) can be mounted to the inner wall 120*a* of the first portion 120, the inner wall 124*a* of the second portion 124, or the inner wall 128*a* of the third portion 128. In addition, in other examples of embodiments, the light source 200 can be mounted to the outer wall 124*b* of the second portion 124 or the outer wall 128*b* of the third portion 128. By providing different mounting surfaces, light can be adjusted to a suitable output based on a desired lighting arrangement. For example, a different light output for a mirror (e.g., task lighting, ambient lighting, accent lighting, etc.) can require light to be emitted in different directions at different intensities. The COB LED strips 200 (or light source 200) can be mounted to any of these surfaces to facilitate the desired light output. Thus, the geometry of the side member 104 advantageously provides a plurality of mounting surfaces for mounting the light source. It should be appreciated that the COB LED strip 200 can include an adhesive backing to facilitate fastening of the strip 200 to the mounting surfaces.

Figure 7:
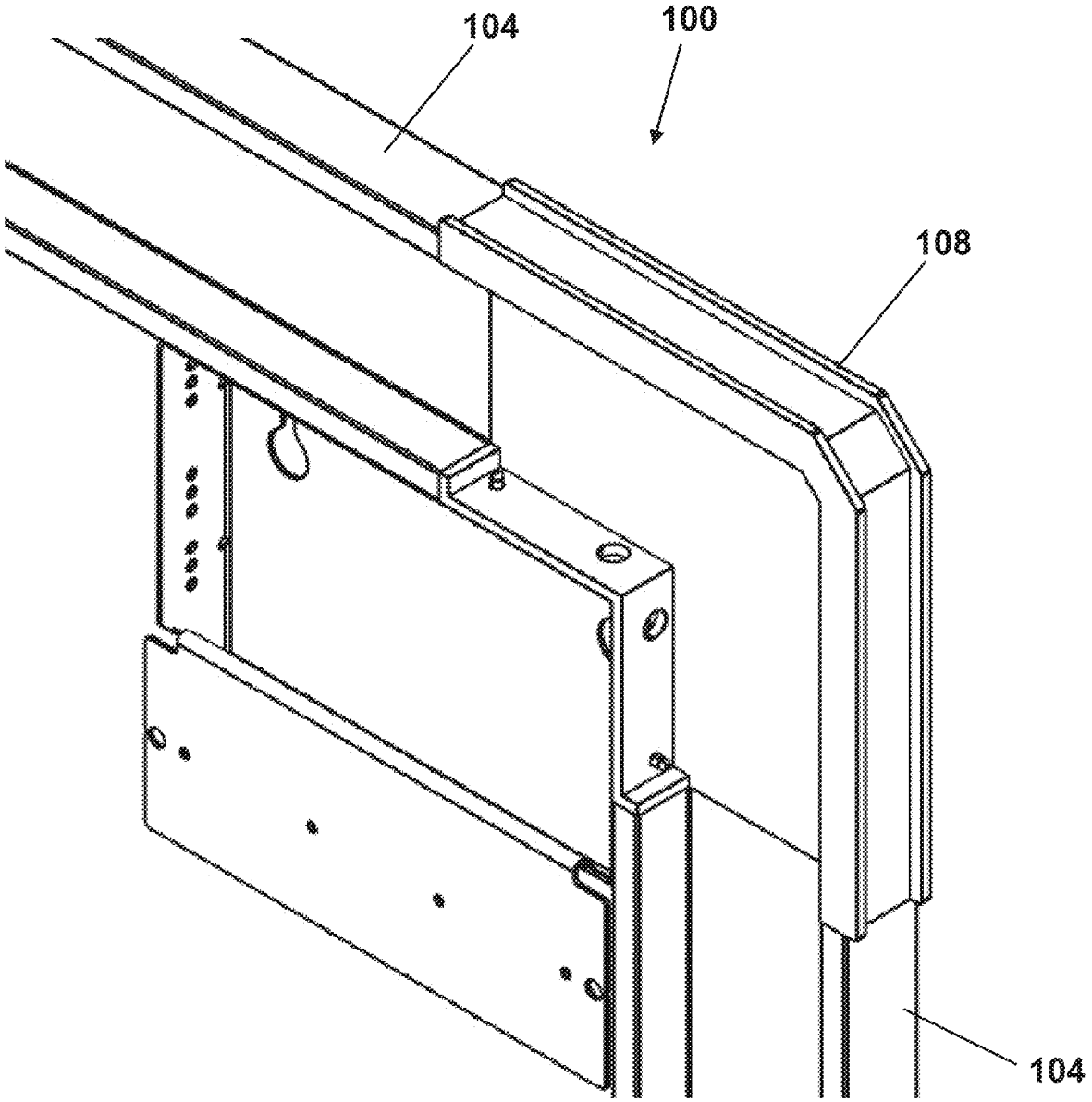
FIG. 7 is a perspective view of a portion of the housing assembly, taken along line 7-7 of FIG. 2.
Figure 8:
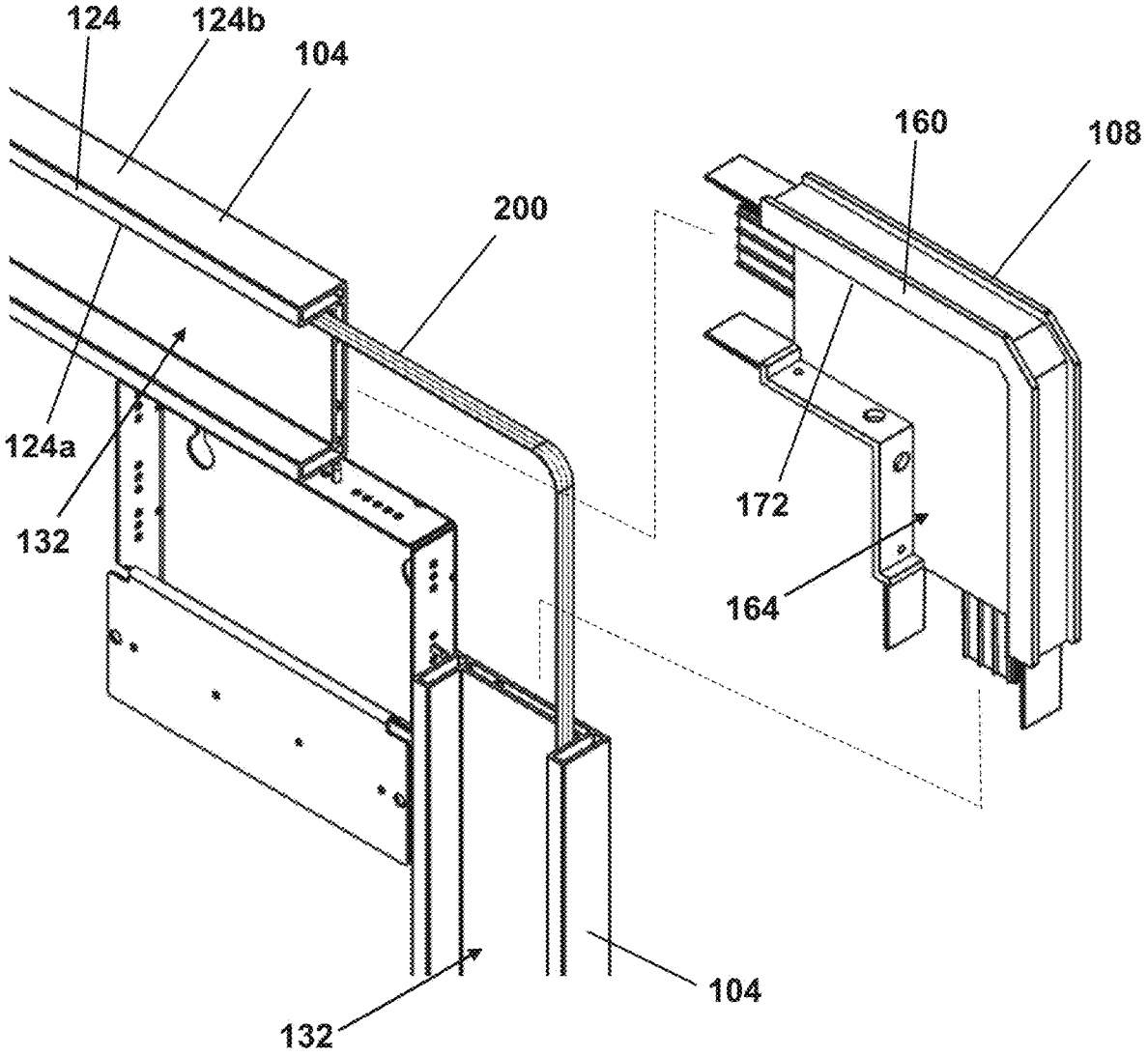
FIG. 8 is a partially exploded view of the housing assembly of FIG. 7, illustrating an example of an embodiment of a corner member disengaged from adjacent side members and illustrating a first light configuration.
Figure 9:
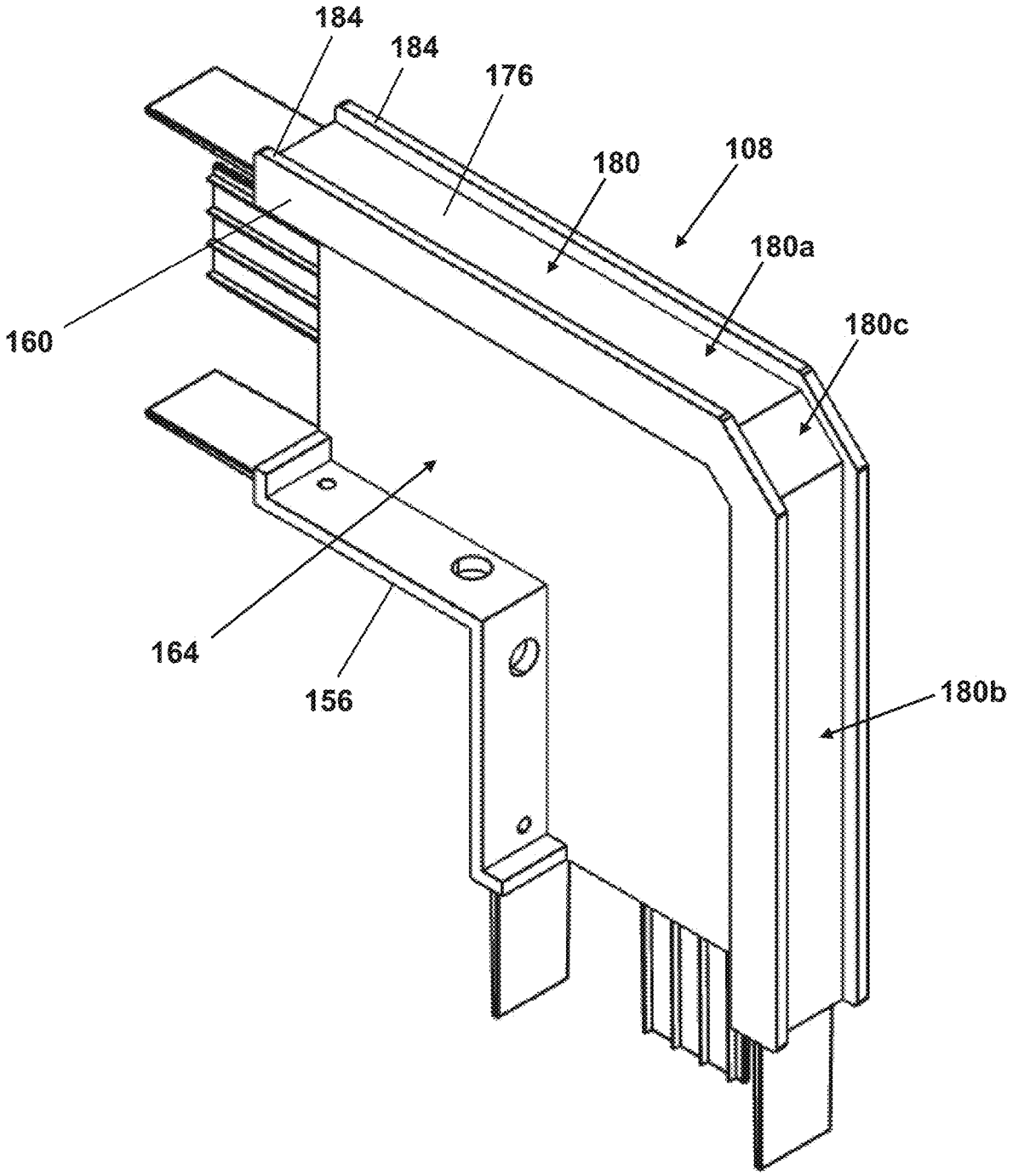
FIG. 9 is a perspective view of an example of an embodiment of the corner member for use with the housing assembly of FIG. 1, the perspective view illustrating an installed orientation with an exposed outer side surface.
Figure 10:
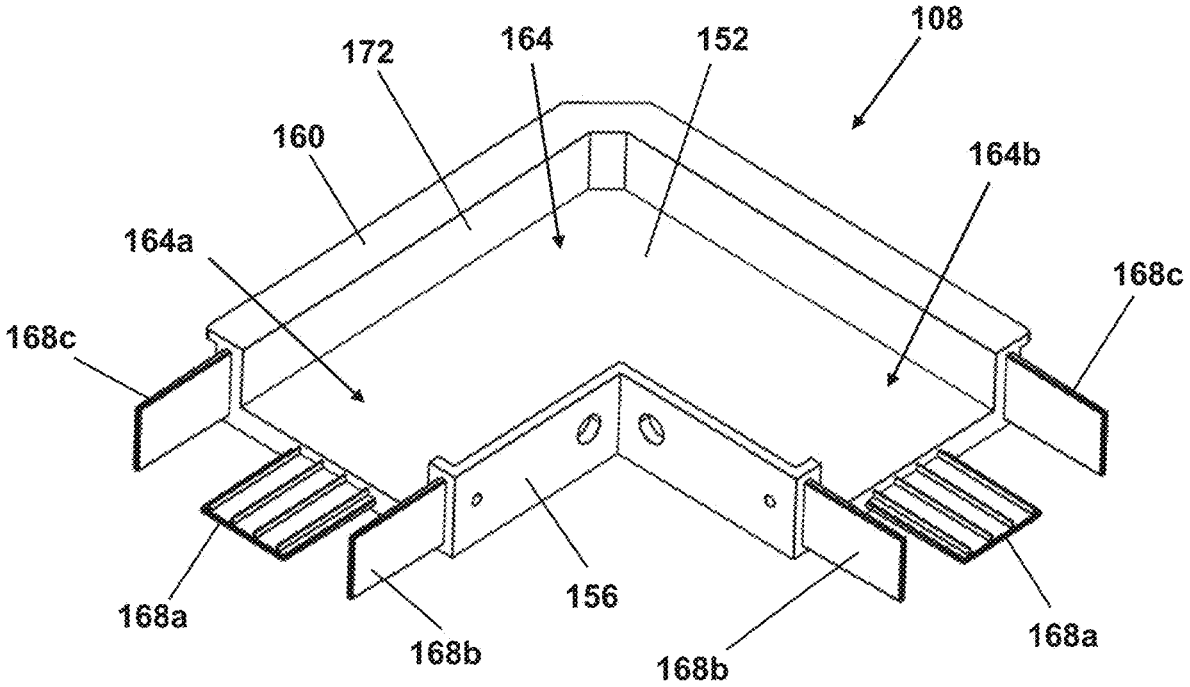
FIG. 10 is a perspective view of the corner member of FIG. 9, illustrating an interior wall surface.

The passages 136, 144, 148 each define slots that are configured to receive a portion of the corner member 108. With reference now to FIGS. 7-8, a perspective view of an example of an embodiment of the corner member 108 is illustrated in engagement with adjacent side members 104 (FIG. 7) and removed from engagement with the respective side members 104 (FIG. 8). With reference to FIGS. 9-10, the corner member 108 (or corner bracket 108) includes a first portion 152, a second portion 156, and a third portion 160. The first portion 152 (or base wall 152 or corner member base wall 152) is arranged between the second portion 156 (or interior wall 156 or interior sidewall 156) and the third portion 160 (or exterior wall 160 or exterior sidewall 160). More specifically, the second and third portions 156, 160 are positioned on opposing edges of the first portion 152. The first, second, and third portions 152, 156, 160 cooperate to define a channel 164 (or a corner member channel 164). The second portion 156 is approximately orthogonal to the first portion 152, and the third portion 160 is approximately orthogonal to the first portion 152. As such, the second and third portions 156, 160 are oriented to be parallel (or approximately parallel) to each other. In other examples of embodiments, the second portion 156 can be oblique to the first portion 152, and the third portion 160 can be oblique to the first portion 152. In the illustrated example of an embodiment, the first portion 152 is wider than a corresponding height of the second and third portions 156, 160.

In the illustrated embodiment, the channel 164 has an approximate U-shaped (or C-shaped) cross-section. The channel 164 is generally the same size as the channel 132 of each side member 104. This allows the channels 132, 164 to cooperate to form a continuous channel around the housing assembly 100. The channel 164 of the corner member 108 generally forms an L-shape. More specifically, the channel 164 includes a first channel portion 164*a* that is oriented orthogonal to a second channel portion 164*b*.

Each end of the corner member 108 includes a plurality of mounting tabs 168*a, b, c*. More specifically, each end of the channel 164 includes a plurality of mounting tabs 168*a, b, c*. For example, the first channel portion 164*a* includes a first mounting tab 168*a* that extends from (or projects from) the first portion 152, a second mounting tab 168*b* that extends from (or projects from) the second portion 156, and a third mounting tab 168*c* that extends from (or projects from) the third portion 160. Similarly, the second channel portion 164*b* includes a plurality of mounting tabs 168*a, b, c*. The first mounting tab 168*a* extends from (or projects from) the first portion 152, the second mounting tab 168*b* extends from (or projects from) the second portion 156, and the third mounting tab 168*c* extends from (or projects from) the third portion 160. While the illustrated embodiment illustrates the plurality of mounting tabs 168 as three total mounting tabs, in other examples of embodiments, there can be two or more mounting tabs 168 or at least one mounting tab 168. It should also be appreciated that each mounting tab 168*a, b, c* is oriented to be parallel to the associated portion 152, 156, 160 of the corner member 108.

Each mounting tabs 168*a, b, c* is configured to be received by one of the associated passages 136, 144, 148 defined by the side member 104 to couple one side member 104 to each end of the corner member 108. Stated another way, each mounting tab 168*a, b, c* is received by an associated passage 136, 144, 148. It should be appreciated that the passages 136, 144, 148 define slots that are configured to receive a portion of the corner member 108. In the illustrated embodiment, the first passage 136 is configured to receive the first tab 168*a*. The second passage 144 is configured to receive the second tab 168*b*. The third passage 148 is configured to receive the third tab 168*c*. By having each of the plurality of mounting tabs 168*a, b, c* of the corner member 108 being received by a respective slot (or passage) 136, 144, 148 of the side member 104, the engagement between the corner member 108 and the side member 104 minimizes light leakage through the assembled housing assembly 100. It should also be appreciated that one or more fasteners (e.g., a screw, a bolt, adhesive, etc.) can be used to further fasten the corner member 108 to each side member 104 following insertion of the mounting tabs 168*a, b, c* into respective slots 136, 144, 148 of the side member 104.

As shown in FIG. 10, the exterior wall 160 (or third portion 160) includes a first side 172 (or an inner side 172 or a channel side 172 or an inner surface 172). The first side 172 partially defines the channel 164. The channel 164 can be referred to as a first channel 164 or an interior corner member channel 164. As illustrated in FIG. 9, the exterior wall 160 also includes a second side 176 (or an outer side 176 or an exterior side 176). The second side 176 includes a second channel 180. More specifically, the second side 176 partially defines the second channel 180. A pair of projections 184 separated by the second side 176 project away from the second side 176 to define the second channel 180. The second channel 180 extends along the exterior wall 160 of the corner member 108. As such, the second channel 180 includes a first channel portion 180*a*, a second channel portion 180*b*, and a third channel portion 180*c*. The first channel portion 180*a* is perpendicular (or orthogonal) to the second channel portion 180*b*. The third channel portion 180*c* connects the first and second channel portions 180*a, b*. The third channel portion 180*c* is oriented at an oblique angle to the first channel portion 180*a*. The third channel portion 180*c* is also oriented at an oblique angle to the second channel portion 180*b*. The second channel 180 can be referred to as an exterior corner member channel 180.

It should be appreciated that the exterior wall 160 of the corner member partially defines the first channel 164 and partially defines the second channel 180. As illustrated, the exterior wall 160 defines a side wall of the first channel 164. The exterior wall 160 also defines a base wall (or bottom wall) of the second channel 180. As such, the second channel 180 is oriented orthogonal (or perpendicular) to the first channel 164.

Figure 11:
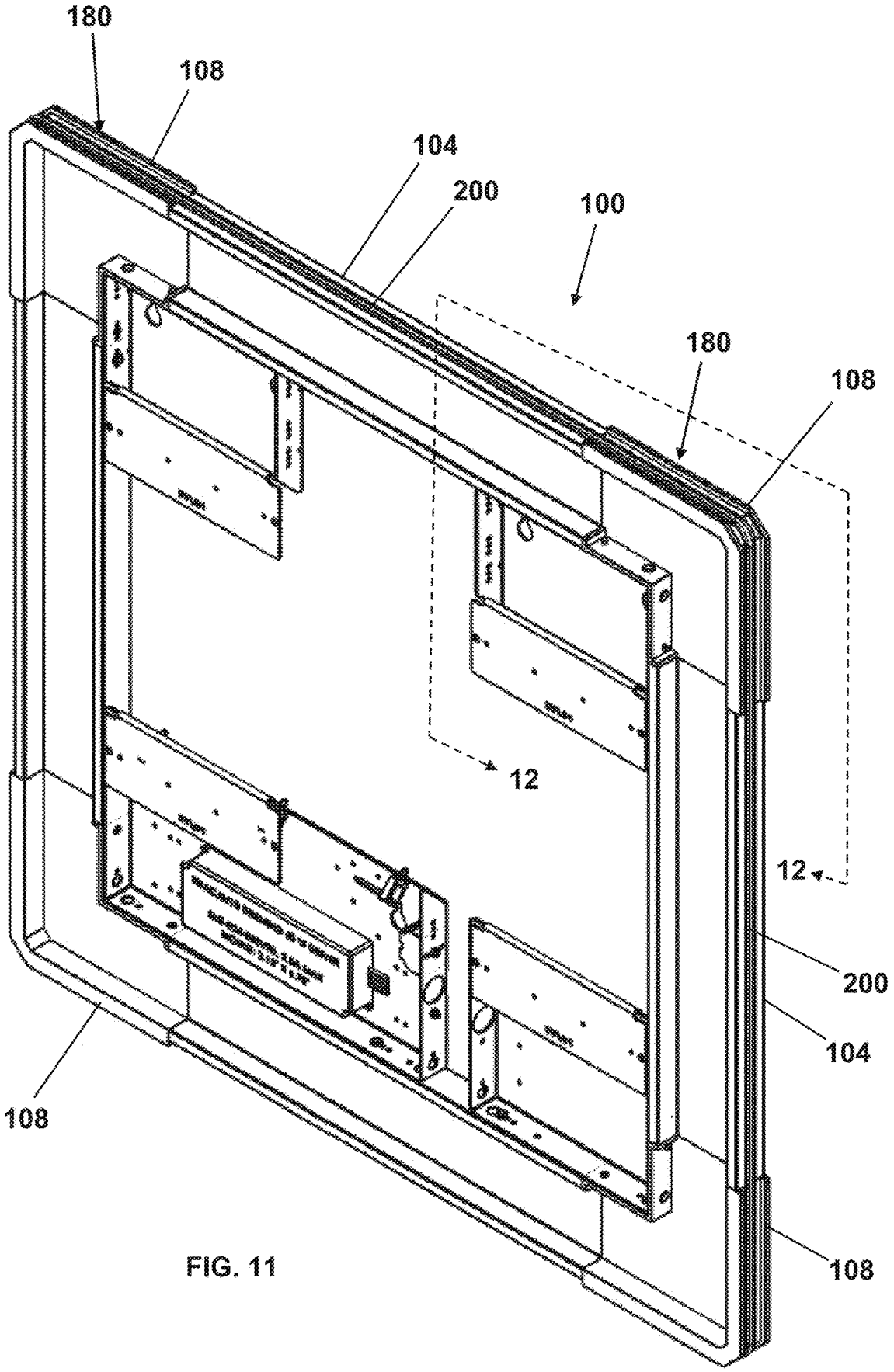
FIG. 11 is a perspective view of another example of an embodiment of the housing assembly of FIG. 3 illustrating a second light configuration.
Figure 12:
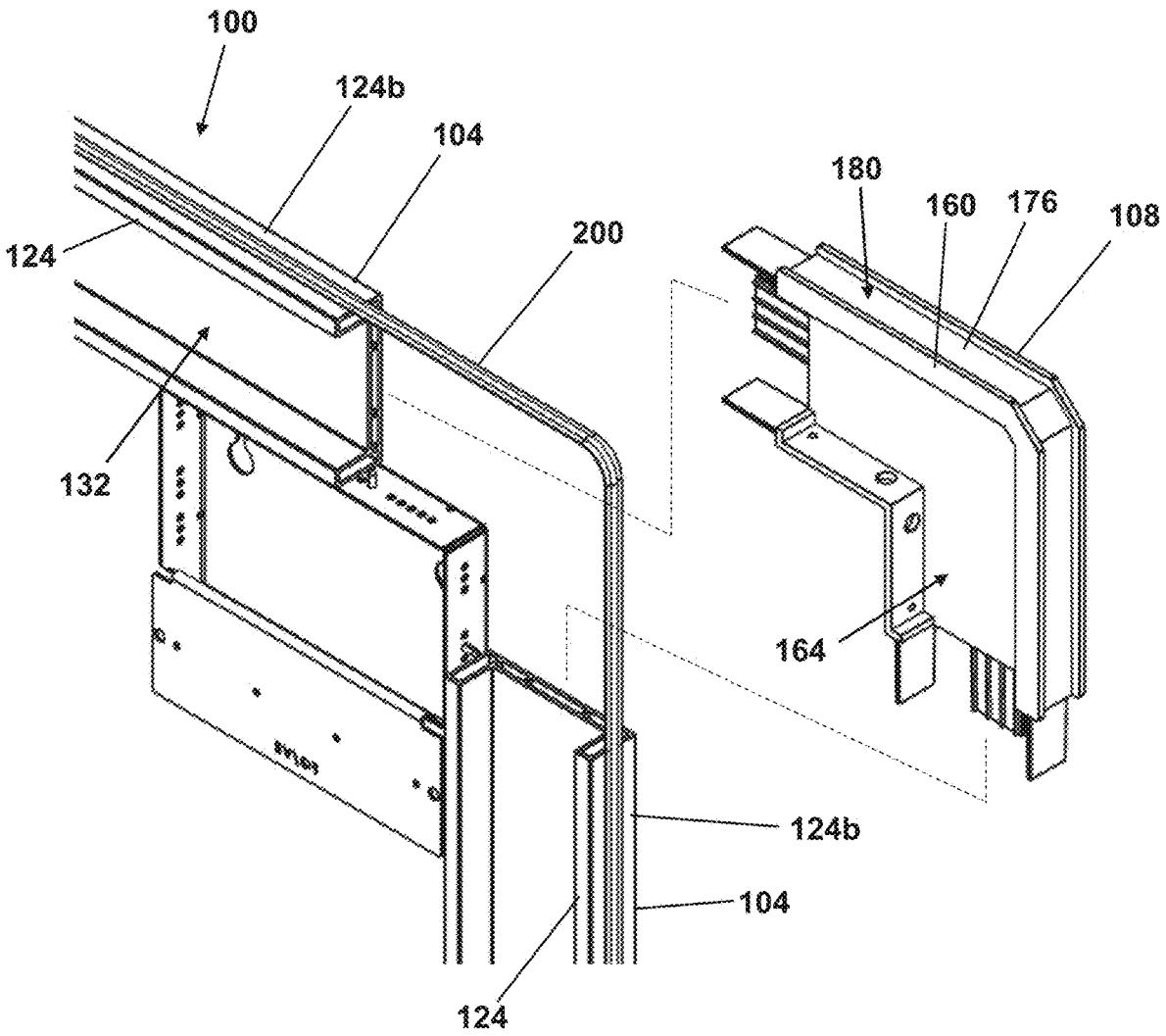
FIG. 12 is a perspective partially exploded view of the housing assembly, taken along line 12-12 of FIG. 11.

The corner member 108 provides a plurality of mounting surfaces for mounting the light source 200 (see FIG. 8). As shown in FIG. 8, in a first light configuration, the light source 200 is configured to fasten (or mount) to a first side of the exterior wall 160. More specifically, the light source 200 is configured to fasten (or mount) to the inner side 172 of the exterior wall 160. Stated another way, the light source 200 is configured to be received by (or fastened to) the first channel 164 of the corner member 108. In a second light configuration, which is shown in FIGS. 11-12, the light source 200 is configured to fasten (or mount) to a second side of the exterior wall 160. More specifically, the light source 200 is configured to fasten (or mount) to the outer side 176 of the exterior wall 160. More specifically, the light source 200 is configured to be received by (or fastened to) the second channel 180 of corner member 108. It should be appreciated that the geometry of the corner member 108 is complimentary to the geometry of the side members 104, and advantageously provides a plurality of mounting surfaces for mounting the light source 200 to direct the light source from one side member 104 around the corner member 108 to an adjacent side member 104.

In the first light configuration, shown in FIG. 8, the light source 200 is configured to be positioned within (or received by) the channels 132, 164 defined by the housing assembly 100, and more specifically respectively defined by the interlocked side members 104 and corner members 108. In the illustrated embodiment, the light source 200 is fastened to the inner wall 124*a* of the first sidewall 124 of each side member 104. The light source 200 is also fastened to the inner side 172 of the exterior wall 160 of each corner member 108. It should be appreciated that in other examples of embodiments, the light source 200 can be fastened other walls that partially define each channel 132, 164. For example, in one embodiment, the light source 200 can be fastened to the inner wall 128*a* of the second sidewall 128 of each side member, and an inner surface of the interior wall 156 of the corner member 108. As another example, in another embodiment, the light source 200 can be fastened to the base wall 120 of each side member 104 and the base wall 152 of each corner member 108.

In the second light configuration, shown in FIG. 12, the light source 200 is configured to be positioned exterior of the channels 132, 164 defined by the housing assembly 100. In the illustrated embodiment, the light source 200 is fastened to the outer wall 124*b* of the first sidewall 124 of each side member 104. The light source 200 is also received by the second channel 180 on the exterior side 176 of the exterior wall 160. Thus, the light source 200 extends around an outer perimeter of the housing assembly 100.

The side members 104 can be made of a highly reflective white polyvinyl chloride (PVC) material. The reflective material can assist with enhancing a desired illumination from the light source. The side members 104 are also pigmented to a level to provide sufficient opacity to minimize light leakage from the light source 200 through the side members 104. The side members 104 are also configured to be formed by extrusion. In other examples of embodiments, the side members 104 can be formed of any plastic, synthetic polymer, or other suitable material to provide the combination of weight, strength, and light reflectivity desired by the housing assembly 100. The side members 104 can be injection molded, or formed of any other suitable process for forming the side member 104.

The corner members 108 can also be made of a highly reflective white polyvinyl chloride (PVC) material. The reflective material can assist with enhancing a desired illumination from the light source. The corner members 108 are also pigmented to a level to provide sufficient opacity to minimize light leakage from the light source 200 through the corner members 108. For example, the corner members 108 can include up to 20% colorant to achieve sufficient opacity to minimize light leakage. In other embodiments, the corner members 108 can be formed of a different color of material than the side members 104. The corner members 108 are configured to be formed by injection molding. In other examples of embodiments, the corner members 108 can be formed of any plastic, synthetic polymer, or other suitable material to provide the combination of weight, strength, and light reflectivity desired by the housing assembly 100. In addition, the corner members 108 can be extruded, or formed of any other suitable process for forming the corner members 108.

Figure 13:
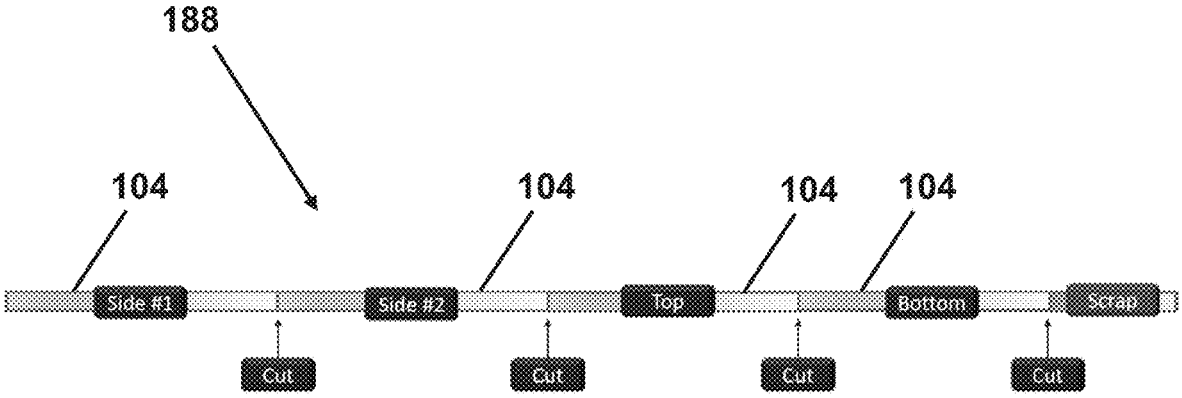
FIG. 13 is an example of an elongated stick that is cut to size to form the side members of FIG. 4.

With reference now to FIG. 13, the side members 104 are configured to be manufactured (or extruded) as an elongated parent member 188. The parent member 188 (or stick 188) can be approximately 8 feet in length to approximately 12 feet in length. However, in other examples of embodiments, the lengths of the parent member 188 can be any suitable length (e.g., shorter than 8 feet, longer than 12 feet, etc.). The parent member 188 has the geometry of the side member 104 illustrated in FIG. 4.

When assembling the customized housing assembly 100, each parent member 188 is cut into a plurality of side members 104. This allows for custom manufacturing to desired lengths of side members 104 based on the size of the custom mirror assembly 10. In the illustrated embodiment, the parent member 188 is cut into four side members 104—two sides of the housing assembly 100, a top of the housing assembly 100, and a bottom of the housing assembly 100. Accordingly, parent member 188 is cut four times to the desired lengths of side members 104. In the illustrated embodiment, after cutting of the parent member 188 to acquire the four side members 104, a portion of the parent member 188 remains as scrap. This scrap can be recycled for reuse as another parent member 188 by the extruder (or other process for forming the parent members 188). In other examples of embodiments, fewer than four side members 104 or more than four side members 104 can be cut from a single parent member 188. In addition, in other examples of embodiments, there may not be any scrap after cutting of the parent member 188 into desired length side members 104.

Once all side members 104 are cut to size, they are assembled to form the housing assembly 100. The housing assembly 100 includes four corner members 108. Each corner members 108 engages two adjacent side members 104 such that the finished housing assembly 100 includes four corner members 108 and four side members 104 (i.e., a top member, a bottom member, and two sides). Each corner member 108 slidably engages two adjacent side members 104 by mounting tabs 188 of the corner member 108 being received by a respective slot (or passage) 136, 144, 148 of the side member 104, as discussed above. Accordingly, the housing assembly 100 alternates between side member 104 and corner member 108 around the assembly 100. Once assembled, the mounting brackets 112*a*, 112*b* can be fastened to the corner members 108, and/or side members 104 by one or more fastener(s) (e.g., a screw, a bolt, adhesive, etc.). The light source is then attached to the housing assembly 100. More specifically, the light source is attached to a suitable surface of the side members 104 and corner members 108 to acquire a desired light output for a desired mirror etch design (e.g., task lighting, ambient lighting, accent lighting, etc.).

One or more aspects of the housing assembly 100 of the mirror assembly 10 provides certain advantages. The side members 104 can be cut to customized lengths from an extruded parent member 188, eliminating the need for prefabricated housing members that are customized for each mirror size. The side members 104 also include an advantageous double wall design that facilitates improved engagement with the corner members 108 to minimize light leakage, while also providing structural rigidity with a reduction in overall weight. The side members 104 and corner members 108 further include a unique geometry to provide a plurality of different mounting surfaces for fastening a light source in order to optimize light output based on a type of illuminated mirror. In addition, the second channel 180 defined by the exterior wall 160 of the corner member 108 is configured to both guide and protect the illumination source 200. More specifically, the second channel 180 is configured to guide the illumination source 200 around an outer perimeter of the housing assembly 100. In addition, since the second channel 180 includes a recessed surface, as the second side 176 is recessed relative to the projections 184, the illumination source 200 is fastened to the second side 176. Thus, the projections 184 protect the illumination source 200 from damage caused by contact with a surface (e.g., the ground, etc.), as the projections 184 absorb any force, deflecting such force (or impact) from contact with the illumination source 200. These and other advantages are realized by the disclosure provided herein.

What is claimed is:

1. A housing assembly for an illuminated mirror comprising:

a side member including a base wall, a first sidewall, and a second sidewall defining a channel, the base wall including an inner base wall spaced from an outer base wall and defining a first slot;

a corner member including a corner member base wall, an interior sidewall, and an exterior sidewall defining a corner member channel, a first mounting tab projecting from a first end of the corner member base wall, wherein the first mounting tab is configured to be received by the first slot of the side member to interlock the corner member to the side member; and a light source, the light source is configured to fasten to the housing assembly in one of a first light configuration or a second light configuration, wherein in response to the light source being fastened to the housing assembly in the first light configuration, the light source is fastened to an exterior surface of the first sidewall and is received by a second channel of the corner member, and wherein in response to the light source being fastened to the housing assembly in the second light configuration, the light source is fastened to an inner surface of the first sidewall and an inner surface of the exterior sidewall.

2. The housing assembly of claim 1, wherein the side member channel has a U-shaped cross sectional shape.

3. The housing assembly of claim 1, the at least one side member further comprising:

the first sidewall including a first inner sidewall spaced from a first outer sidewall and defining a second slot; and the second sidewall including a second inner sidewall spaced from a second outer sidewall and defining a third slot.

4. The housing assembly of claim 3, the at least one corner member further comprising:

a second mounting tab projecting from a first end of the interior sidewall, and a third mounting tab projection from a first send of the exterior sidewall, wherein the second mounting tab is configured to be received by the second slot of the side member, and the third mounting tab is configured to be received by the third slot of the side member to interlock the corner member to the side member.

5. The housing assembly of claim 1, wherein the exterior sidewall of the corner member includes the second channel.

6. The housing assembly of claim 5, wherein the exterior sidewall of the corner member partially defines the corner member channel and partially defines the second channel.

7. The housing assembly of claim 5, wherein the second channel is oriented perpendicular to the corner member channel.

8. The housing assembly of claim 1, wherein the inner surface of the exterior sidewall partially defines the corner member channel.

9. The housing assembly of claim 1, wherein the light source is a light emitting diode strip.

10. The housing assembly of claim 1, wherein the light source is a chip on board light emitting diode strip.

11. A housing assembly for an illuminated mirror comprising:

alternating interlocking side members and corner members, each side member including a base wall, a first sidewall, and a second sidewall defining a side member channel, the base wall including an inner base wall spaced from an outer base wall and defining a first slot;

each corner member including a corner member base wall, an interior sidewall, and an exterior sidewall defining a first corner member channel, a first mounting tab projecting from a first end of the corner member base wall, and a second mounting tab projecting from a second end of the corner member base wall, wherein the first mounting tab is configured to be received by the first slot of one adjacent side member, and the second mounting tab is configured to be received by the first slot of the other adjacent side member; and a light source configured to fasten to the housing assembly in one of a first light configuration or a second light configuration, wherein in the first light configuration, the light source is fastened to an exterior surface of the first sidewall of each side member and is received by a second corner member channel of each corner member, and wherein in the second light configuration, the light source is fastened to an interior surface of the first sidewall of each side member and is fastened to the inner surface of the exterior sidewall of each corner member.

12. The housing assembly of claim 11, wherein an inner surface of the exterior sidewall of each corner member partially defines the first corner member channel, and an outer surface of the exterior sidewall of each corner member partially defines the second corner member channel.

13. The housing assembly of claim 12, wherein the first corner member channel is oriented perpendicular to the second corner member channel.

14. The housing assembly of claim 12, wherein the second corner member channel includes a first channel portion, a second channel portion, and a third channel portion, the first channel portion is perpendicular to the second channel portion, and the third channel portion is oriented oblique to both the first channel portion and the second channel portion.

15. The housing assembly of claim 11, wherein the light source is a light emitting diode strip.

16. The housing assembly of claim 11, wherein the light source is a chip on board light emitting diode strip.

17. The housing assembly of claim 11, each side member further comprising:

the first sidewall including a first inner sidewall spaced from a first outer sidewall and defining a second slot; and the second sidewall including a second inner sidewall spaced from a second outer sidewall and defining a third slot; and each one corner member further comprising:

a third mounting tab projecting from a first end of the interior sidewall, and a fourth mounting tab projecting from a second end of the interior sidewall, a fifth mounting tab projection from a first end of the exterior sidewall, and a sixth mounting tab projecting from a second end of the exterior sidewall, wherein the third mounting tab is configured to be received by the second slot and the fifth mounting tab is configured to be received by the third slot of one adjacent side member, and the fourth mounting tab is configured to be received by the second slot and the sixth mounting tab is configured to be received by the third slot of the other adjacent side member.

* * * * *